US010001128B2

(12) United States Patent
Lin et al.

(10) Patent No.: US 10,001,128 B2
(45) Date of Patent: Jun. 19, 2018

(54) FAN IMPELLER

(71) Applicant: COOLER MASTER CO., LTD., New Taipei (TW)

(72) Inventors: Chen-Yang Lin, New Taipei (TW); Kuo-Chun Hung, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 451 days.

(21) Appl. No.: 14/704,186

(22) Filed: May 5, 2015

(65) Prior Publication Data

US 2016/0290355 A1 Oct. 6, 2016

(30) Foreign Application Priority Data

Mar. 31, 2015 (TW) ..... 104204813 U

(51) Int. Cl.

| | |
|---|---|
| ***F01D 5/22*** | (2006.01) |
| ***F04D 29/02*** | (2006.01) |
| ***F04D 29/28*** | (2006.01) |
| ***F04D 29/30*** | (2006.01) |

(52) U.S. Cl.

CPC ..... *F04D 29/023* (2013.01); *F04D 29/281* (2013.01); *F04D 29/30* (2013.01); *F05D 2230/23* (2013.01); *F05D 2230/54* (2013.01); *F05D 2300/10* (2013.01); *F05D 2300/43* (2013.01)

(58) Field of Classification Search

CPC ..... F04D 29/281; F04D 25/0613

USPC ..... 416/191

See application file for complete search history.

(56) References Cited

U.S. PATENT DOCUMENTS

| | | | | |
|---|---|---|---|---|
| 5,611,668 | A * | 3/1997 | Yapp | F04D 29/023 416/189 |
| 7,358,630 | B2 * | 4/2008 | Vasilescu | F04D 29/281 310/58 |
| 7,614,851 | B2 * | 11/2009 | Lu | F04D 29/023 29/889.4 |
| 8,025,484 | B2 * | 9/2011 | Sun | F04D 29/325 416/183 |
| 9,011,100 | B2 * | 4/2015 | Ulgen | B63H 1/20 416/212 R |

* cited by examiner

*Primary Examiner* — Logan Kraft
*Assistant Examiner* — Jason Fountain
(74) *Attorney, Agent, or Firm* — Maschoff Brennan

(57) ABSTRACT

A fan impeller includes a plurality of fan blade assembly members, each one of the fan blade assembly members respectively includes a metal ring bracket and a plurality of metal blades, one end of each one of the metal blades is respectively connected to the corresponding metal ring bracket and the plurality of metal blades of each one of the fan blade assembly members arranged radially to circumference the corresponding metal ring bracket. The metal ring brackets are configured to stack with each other and the metal blades are arranged in a radial centric row, a width of at least one portion of each one of the metal blades is not smaller than a distance between any two adjacent metal blades along a fan impeller circumferential direction. Accordingly, metal blades of a greater width can be densely arranged on the fan impeller.

14 Claims, 13 Drawing Sheets

FAN IMPELLER

BACKGROUND OF THE INVENTION

Field of the Invention

The present invention is related to a heat dissipating fan, in particular, to a fan impeller with a stacked fan blade assembly.

Description of Related Art

The heat dissipating fans nowadays can mostly be categorized into two structural types of one type having blades integrally formed with a fan hub and the other type having metal stamping blades.

The first type of the structure having the blades integrally formed with the fan hub is simple and the manufacturing process is also relatively simple; therefore, it can be manufactured into a thin heat dissipating fan of a small size. The smallest allowable thickness of the blades of such structure is limited by the strength of the plastic structure and the technical level of the injection molding manufacturing process. Such type of structure cannot be arranged with more blades within a limited space; consequently, it is limited by the level of the manufacturing process such that it cannot be further improved to enhance its performance.

The second type of the structure having metal stamping formed blades can be manufactured to have relatively thinner blades; however, the stamped material is limited by the space in the horizontal plane. As a result, when there is a need to increase the number of blades, if all of the blades are to be integrally made as one single piece, then the width of the blade must be reduced correspondingly; if there is a need for a larger blade width, then each single blade must be formed by stamping individually. Consequently, it requires a higher manufacturing cost to use the method of manufacturing each single blade individually followed by the assembly in order to satisfy the need for densely arranging wide blades together.

In view of the above, the inventor seeks to overcome the problems associated with the currently existing technique after years of research and development along with the utilization of theoretical principles, and it is an objective of the inventor to provide a reasonable design and an improvement capable of effectively solve the aforementioned problems.

SUMMARY OF THE INVENTION

The present invention provides a fan impeller with a stacked fan blade assembly.

The present invention provides a fan impeller comprising a plurality of fan blade assembly members, each one of the fan blade assembly members respectively comprising a metal ring bracket and a plurality of metal blades, one end of each one of the metal blades respectively connected to the corresponding metal ring bracket and the plurality of metal blades of each one of the fan blade assembly members arranged radially to circumference the corresponding metal ring bracket; wherein the metal ring brackets are configured to stack with each other and the metal blades are arranged in a radial centric row, a width of at least one portion of each one of the metal blades is not smaller than a distance between any two adjacent metal blades along a fan impeller circumferential direction.

Preferably, another end of each one of the metal blades is respectively formed of a connecting structure, the connecting structure is connected to the adjacent metal blade, the connecting structure can be locked onto the adjacent metal blade. The fan impeller further comprises an outer ring bracket, the outer ring bracket circumferences each one of the metal ring brackets, and the outer ring bracket is respectively connected to each one of the metal blades. Another end of each one of the metal blades is respectively formed of a clamping engagement structure, and the clamping engagement structure is embedded at the outer ring bracket. The fan impeller further comprises a fan hub, the metal ring brackets are embedded at the fan hub. The fan impeller further comprises a rotational axle assembly member, the metal ring brackets circumference the rotational axle assembly member, and the rotational axle assembly member is embedded at the fan hub. Each one of the metal blades is connected to an outer edge of the corresponding metal ring bracket, a connecting area between each one of the metal blades and the corresponding metal ring bracket is bent. Wherein an inner edge of the metal ring bracket includes a ring wall extended therefrom, and the reset of each one of the metal ring brackets are mounted onto the ring wall.

The fan impeller of the present invention uses the method of stacking a plurality of fan blade assembly members together in order to form an assembly of metal blades; therefore, the present invention not only allows the manufacturing of metal blades with larger width but also allows the metal blades to be densely arranged inside the fan impeller in order to increase the air quantity and to enhance the heat dissipation efficiency.

DETAILED DESCRIPTION OF THE INVENTION

Figure 1:
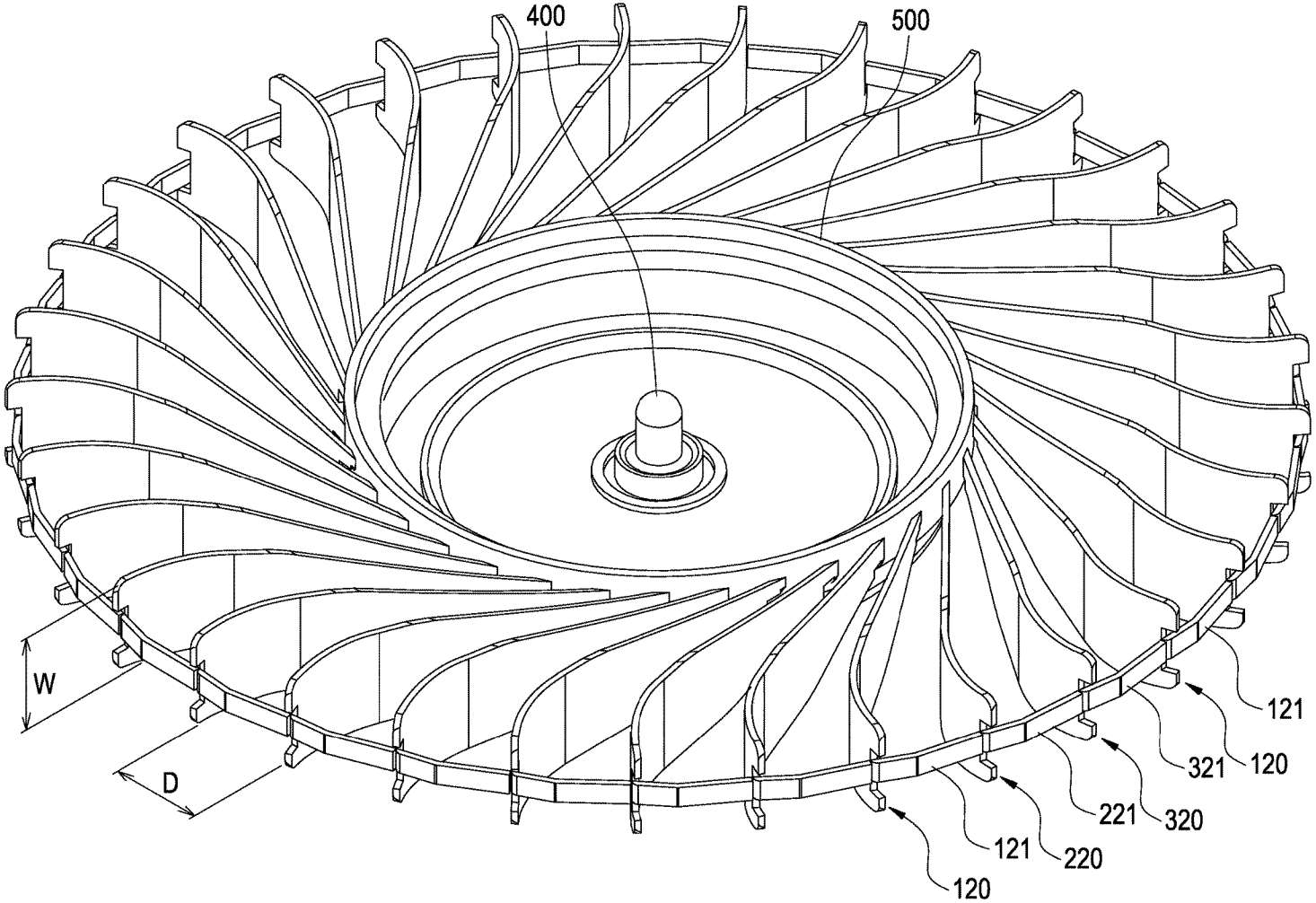
FIG. 1 is a perspective view of a fan impeller according to a first embodiment of the present invention.
Figure 2:
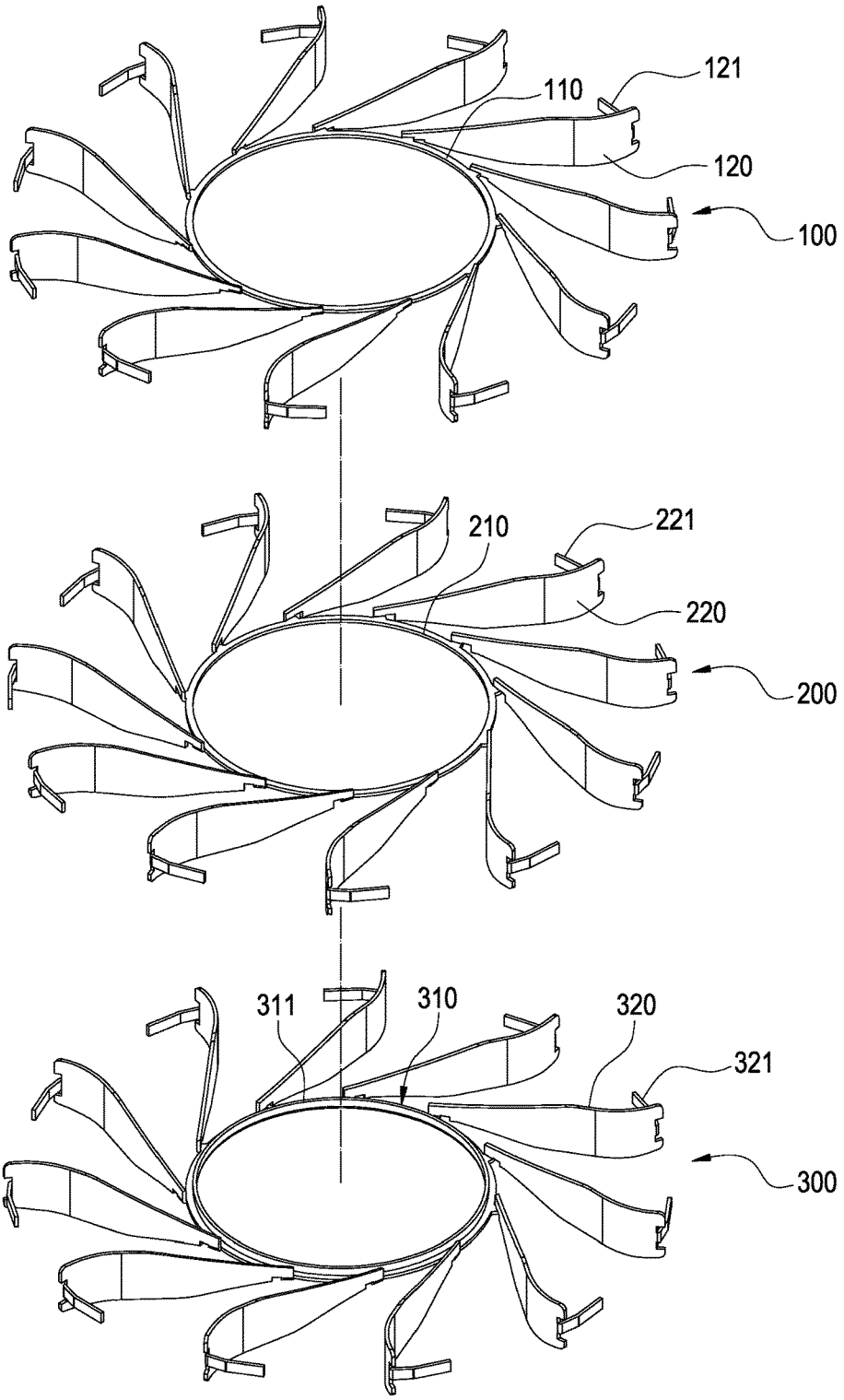
FIG. 2 is a perspective exploded view of the fan blade assembly members according to the first embodiment of the present invention.
Figure 3:
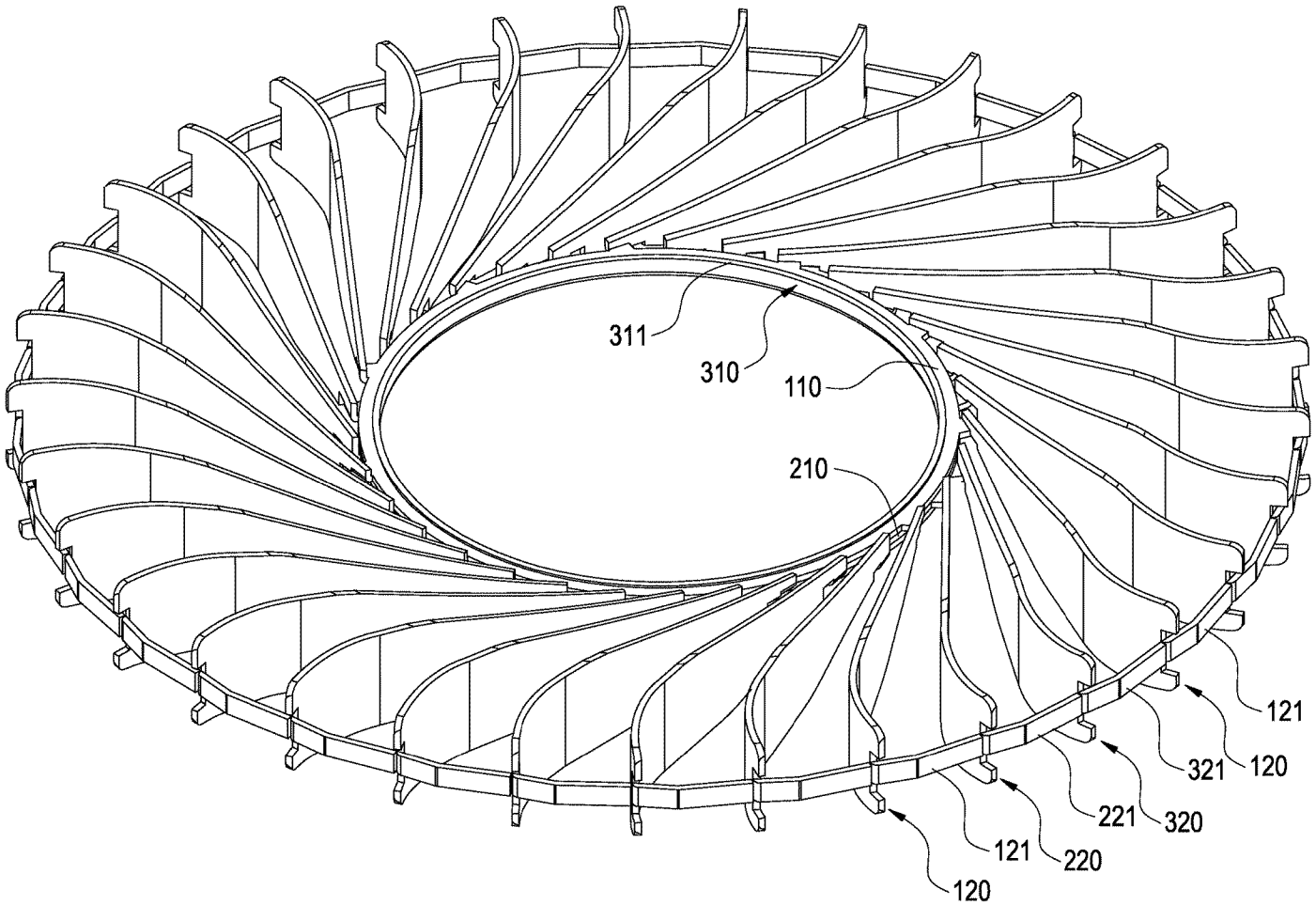
FIG. 3 is a perspective assembly view of the fan blade assembly members altogether according to the first embodiment of the present invention.
Figure 4:
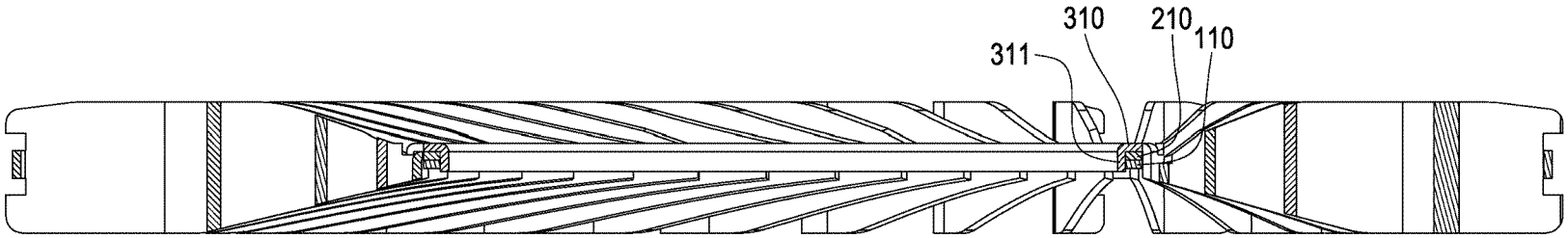
FIG. 4 is a radial cross sectional view of the fan blade assembly members altogether according to the first embodiment of the present invention.

Please refer to FIG. 1 to FIG. 5. According to a first embodiment of the present invention, fan impeller is provided, which comprises: a plurality of fan blade assembly members 100/200/300, a rotational axle assembly member 400 and a fan hub 500.

In this embodiment, the fan impeller of the present invention preferably comprises 3 fan blade assembly members 100/200/300 configured to stack with each other; however, the present invention is not limited to such quantity number only. Each fan blade assembly member 100/200/300 respectively comprises an integrally formed metal ring bracket 110/210/310 and a plurality of metal blades 120/220/320 corresponding to each metal ring bracket 110/210/310. Each metal blade 120/220/320 is of an elongated shape, and one end of each metal blade 120/220/320 is respectively connected to an outer edge of the corresponding metal ring bracket 110/220/330. A connecting area between each metal blade 120/220/320 and the corresponding metal ring bracket 110/210/310 is bent in order to allow each metal blade 120/220/320 to have two surfaces arranged vertical to the corresponding metal ring bracket 110/210/310 overall. Another end of each metal blade 120/220/320 is respectively formed of a connecting structure 121/221/321. The plurality of metal blades 120/220/320 are arranged to radially circumference the corresponding metal ring brackets 110/210/310. The metal blades 120/220/320 can be arranged at an angle along a radial direction of the metal ring brackets 110/210/310; the metal blades 120/220/320 can also be arranged at angle with the radial direction of the metal ring brackets 110/210/310, and the present invention is not limited any particular angle formed therebetween.

The plurality of metal ring brackets 110/210/310 are arranged to stack with each other in order to allow the plurality of metal blades 120/220/320 to be in a radial centric row. A width W of at least one portion of each metal blade 120/220/320 is not smaller than a distance D between any two adjacent metal blades 120/220/320 being stacked in a fan impeller circumferential direction. The structure of each fan blade assembly members 100/200/300 are generally the same; however, to allow the plurality of metal blades 120/220/320 to be disposed on one identical plane, the metal blades 120/220/320 in each fan blade assembly member 100/200/300 are slightly different from the relative positions of the corresponding metal ring bracket 110/210/310 in such a way that by cooperatively stacking the three fan blade assembly members 100/200/300 with each other in sequence, the plurality of metal blades 120/220/320 can be disposed on one identical plane.

An inner edge of one of the metal brackets 310 includes a ring wall 311 extended therefrom, and the rest of each one of the metal ring brackets 110/210 are mounted onto the ring wall 311 sequentially in order to allow the three metal ring brackets 110/210/310 to be mounted and stacked onto each other for securement; thereby, the three fan blade assembly members 100/200/300 can be assembled with ease.

The connecting structure 121/221/321 is connected to the adjacent metal blade 120/220/320. In this embodiment, each connecting structure 121/221/321 is respectively connected to the connecting structure 221/321/121 of another adjacent metal blade 220/320/120 such that the plurality of connecting structures 121/221/321 can be connected in series into a ring. Therefore, the connecting structures 121/221/321 are able to achieve the effects of positioning the metal blades 120/220/320 and the strengthening the structure of the fan impeller.

The plurality of metal ring brackets 110/210/310 circumference the rotational axle assembly member 400. In addition, by using the enclosure injection molding method, the fan hub 500 can be formed in order to allow the metal ring brackets 110/210/310 and the rotational axle assembly member to be all embedded inside the fan hub 500; thereby, the fan hub 500 is able to combine the fan blade assembly members 100/200/300 and the rotational axle assembly member 400 into one unit. Wherein, the fan impeller is used for pivotally attaching onto a fan base (not shown in the figure) in order to be rotated on the fan base.

Figure 5:
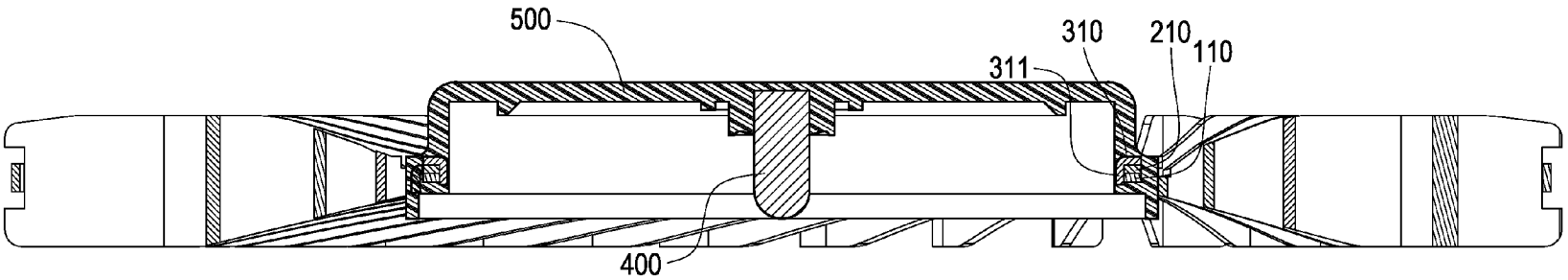
FIG. 5 is a radial cross sectional view of the fan impeller according to the first embodiment of the present invention.
Figure 6:
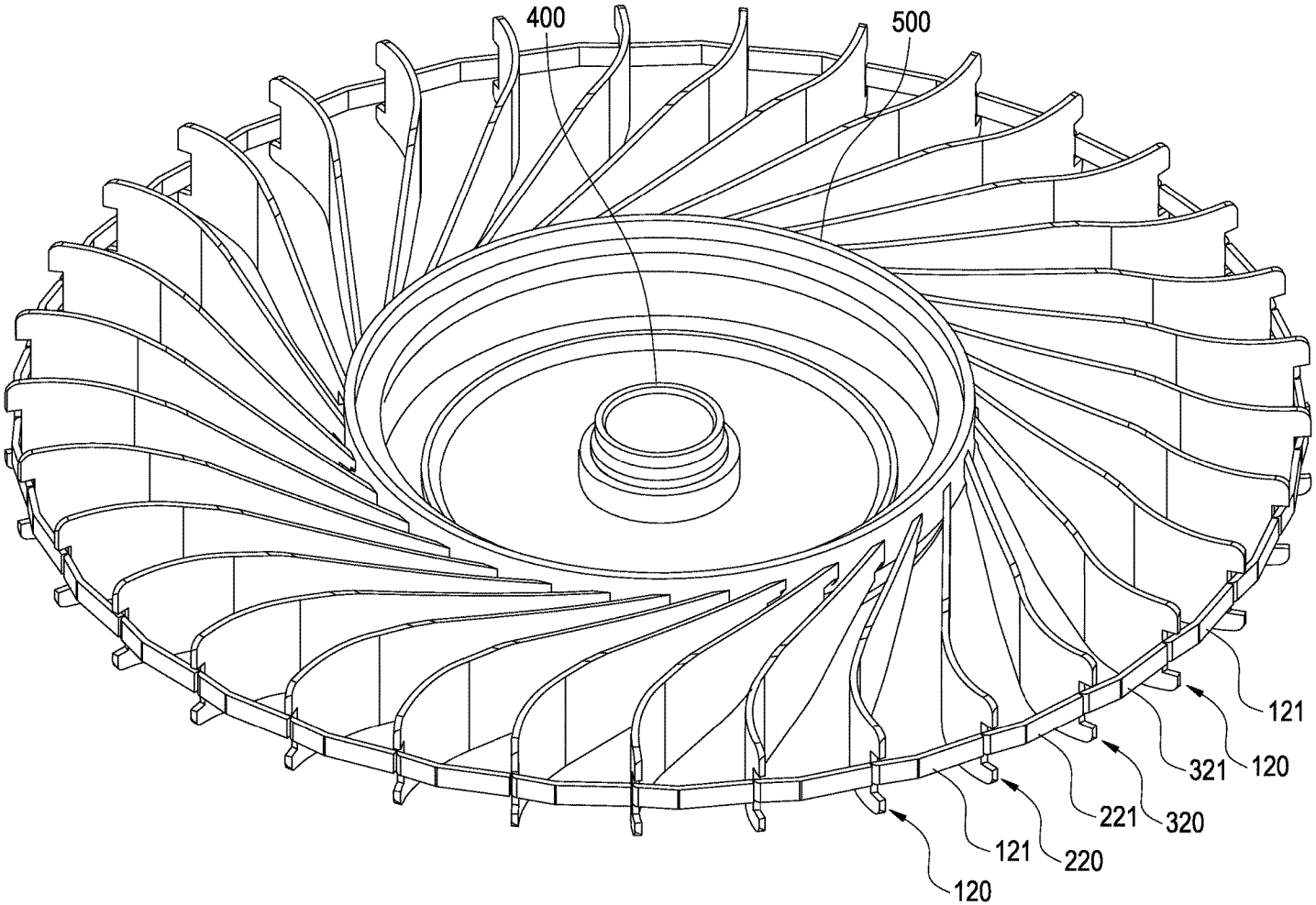
FIG. 6 is a possible variation view of the rotational axle assembly member according to the first embodiment of the present invention.

As shown in FIG. 5 and FIG. 6, for different the pivotal attachment structures on the fan base, the fan impeller can be configured with a different type of rotational axle assembly member 400 correspondingly. For example, when the pivotal attachment structure on the fan base is a metal cylinder type, the fan impeller can be configured to include a rotational axle assembly member 400 of a metal shaft type, as shown in FIG. 5; when the pivotal attachment structure on the fan base is a metal shaft type, the fan impeller then needs to be configured to include a rotational axle assembly member 400 of a metal cylinder type, as shown in FIG. 6.

Figure 7:
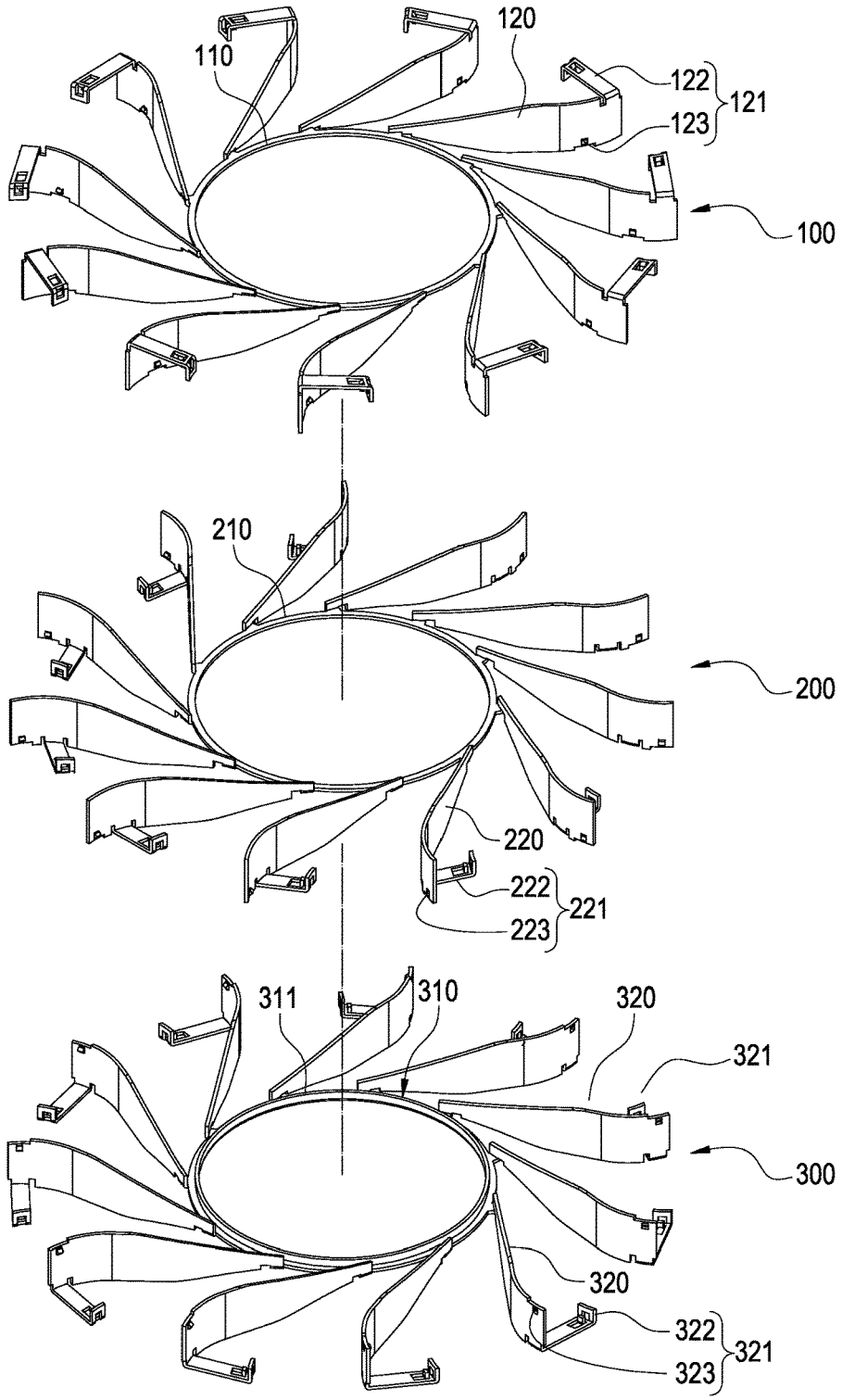
FIG. 7 is a perspective exploded view of the fan blade assembly members according to a second embodiment of the present invention.
Figure 8:
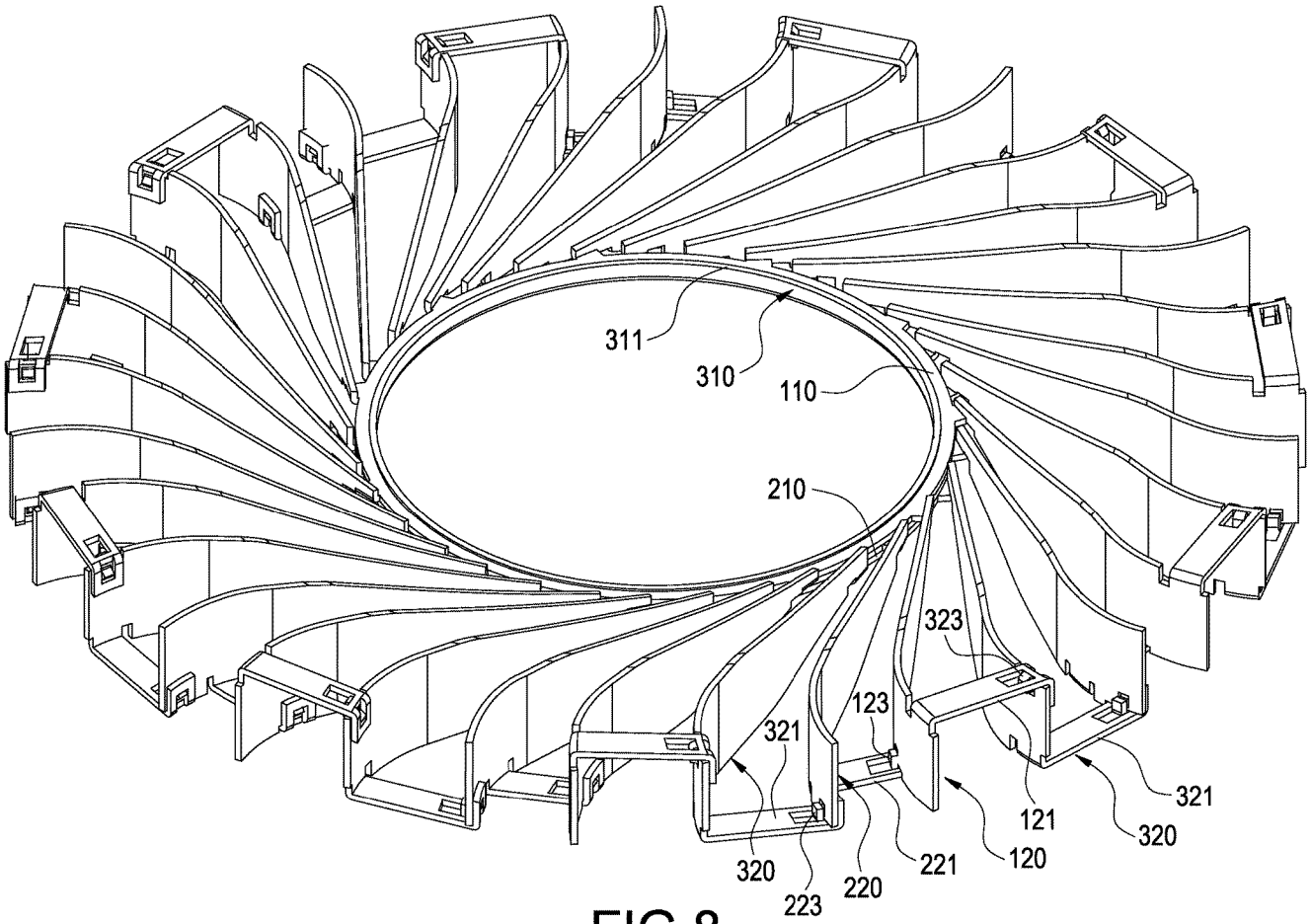
FIG. 8 is a perspective assembly view of the fan blade assembly members altogether according to the second embodiment of the present invention.
Figure 9:
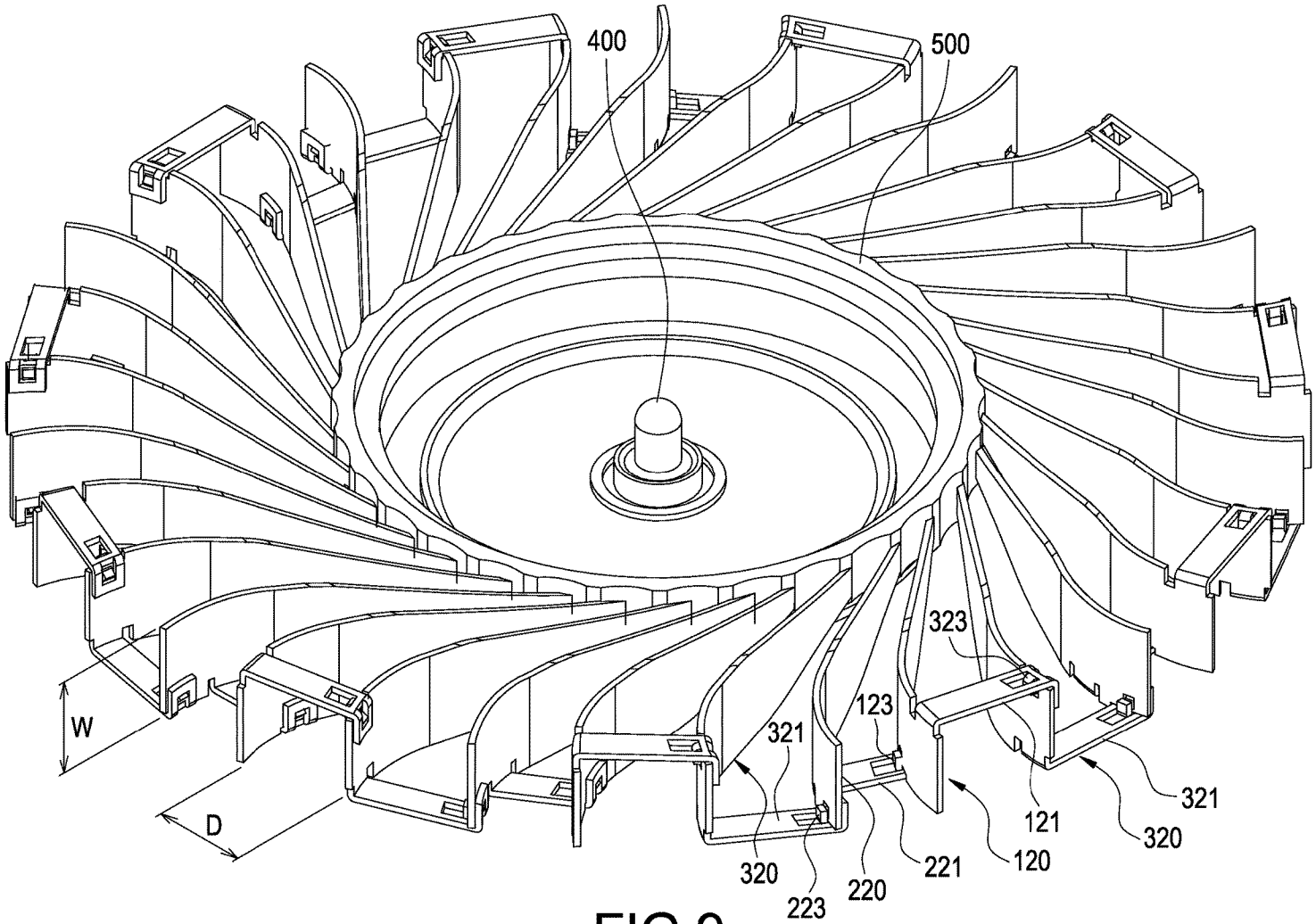
FIG. 9 is a perspective view of a fan impeller according to the second embodiment of the present invention.

As shown in FIG. 7 to FIG. 9, according to a second embodiment of the present invention, a fan impeller is provided, which comprises: a plurality of fan blade assembly members 100/200/300, a rotational axle assembly member 400 and a fan hub 500; since its structure is generally identical to that of the aforementioned first embodiment, their similarities are omitted hereafter.

The second embodiment differs from the first embodiment mainly relies in that the connecting structure 121/221/321 of each metal blade comprises a hooking arm 122/222/322 and a protruding piece 123/223/322. Each metal blade 120/220/320 uses the hooking arm 122/222/322 to lock onto the protruding piece 323/123/223 of the adjacent metal blade 320/120/220; therefore, the connecting structures 121/221/322 are able to achieve the effects of positioning the metal blades 120/220/320 and strengthening the fan impeller structure.

Figure 10:
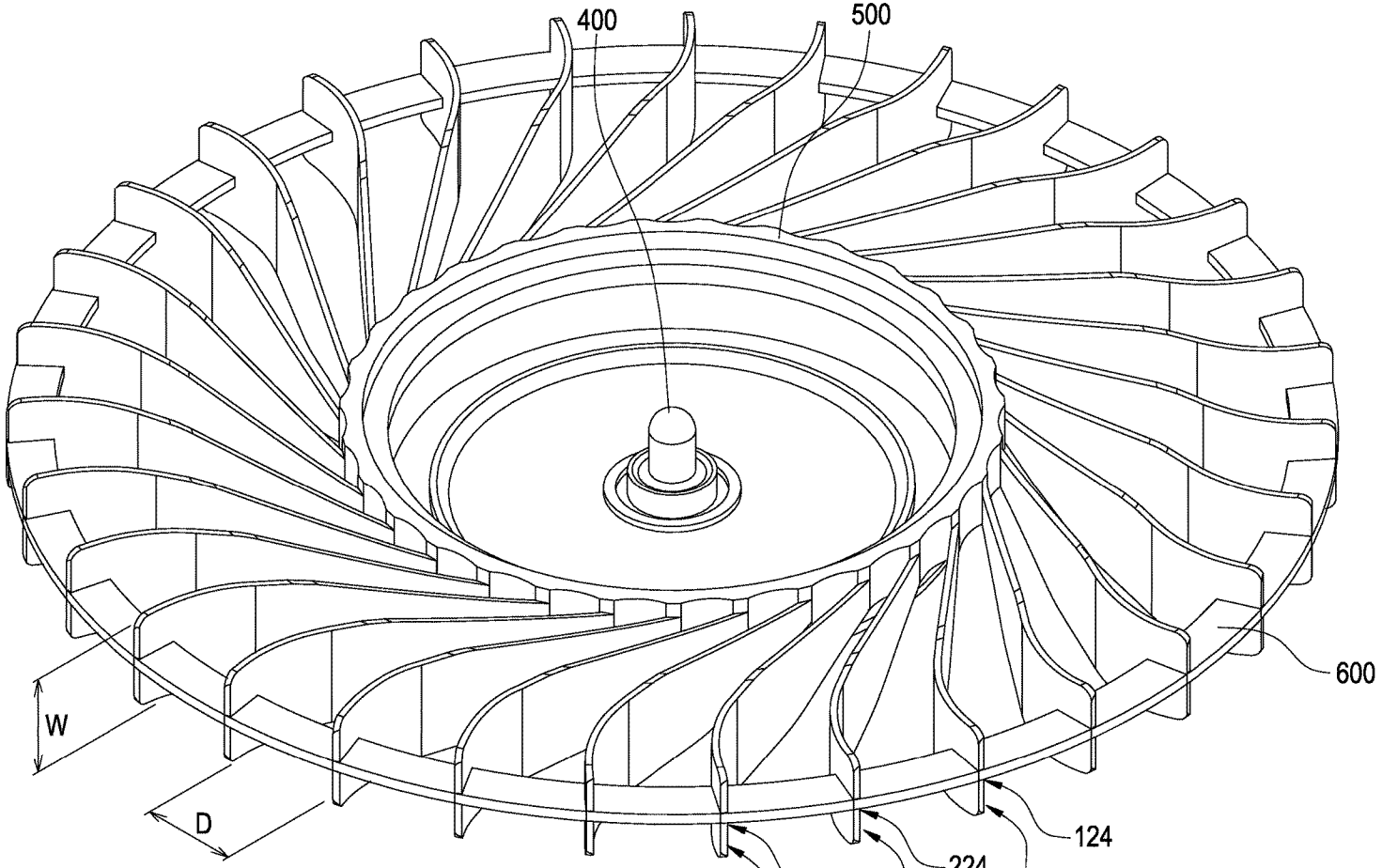
FIG. 10 is a perspective view of a fan impeller according to a third embodiment of the present invention.
Figure 11:
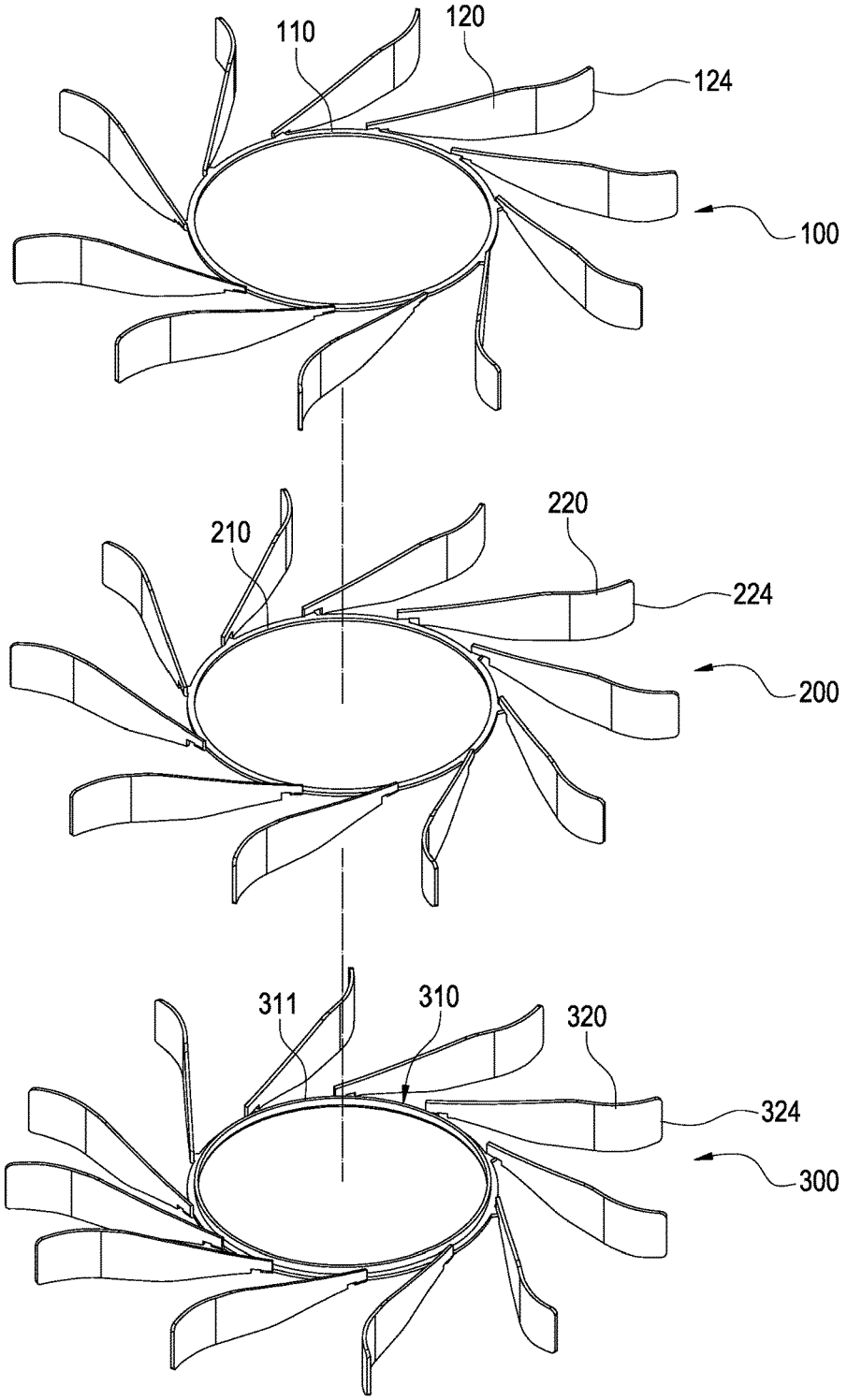
FIG. 11 is a perspective exploded view of the fan blade assembly members according to a third embodiment of the present invention.
Figure 12:
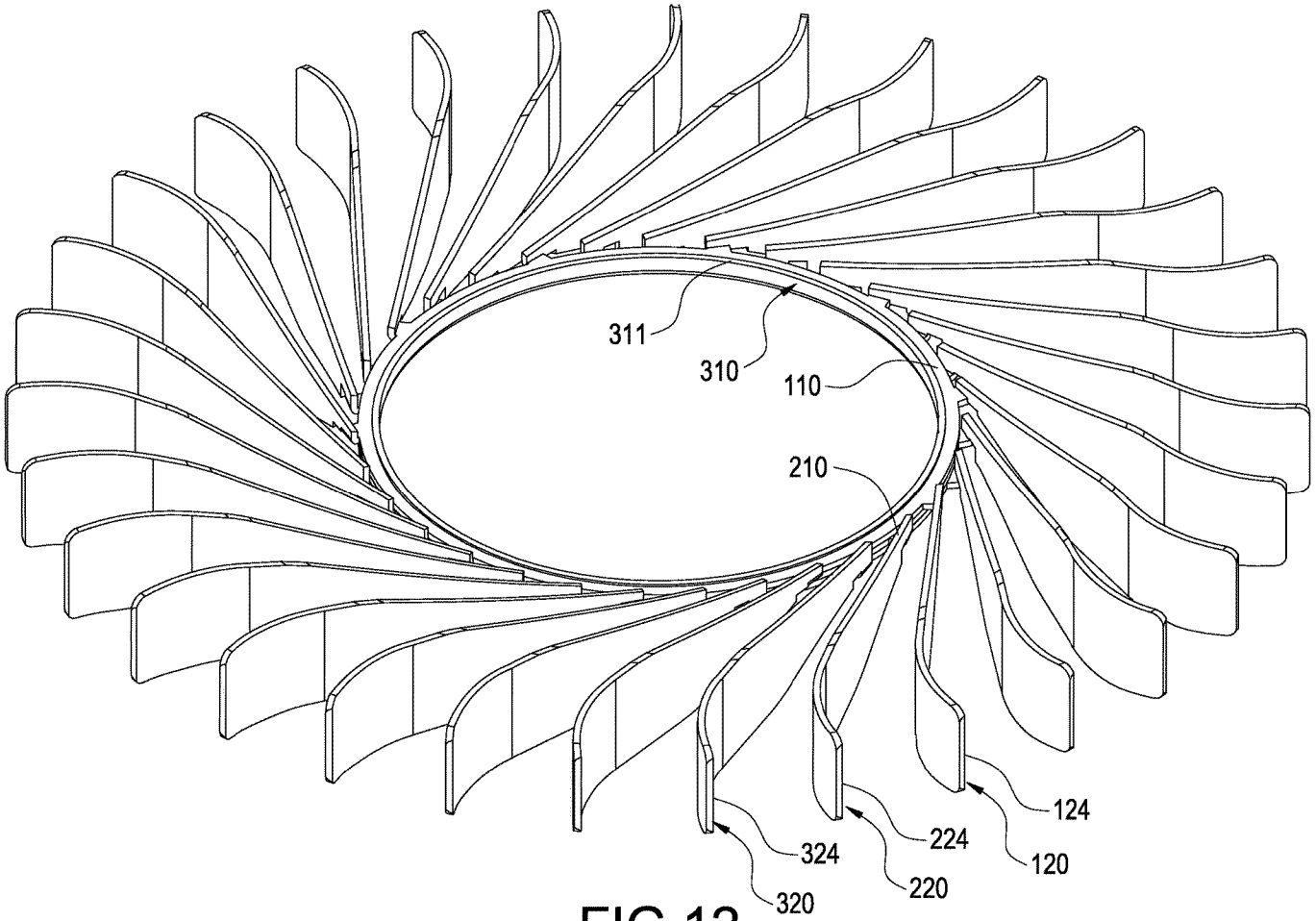
FIG. 12 is a perspective assembly view of the fan blade assembly members altogether according to the third embodiment of the present invention.

Please refer to FIG. 10 to FIG. 12. According to a third embodiment of the present invention, a fan impeller is provided, which comprises: a plurality of fan blade assembly members 100/200/300, a rotational axle assembly member 400, a fan hub 500 and an outer ring bracket 600; since its structure is generally identical to that of the aforementioned first embodiment, their similarities are omitted hereafter.

Figure 13:
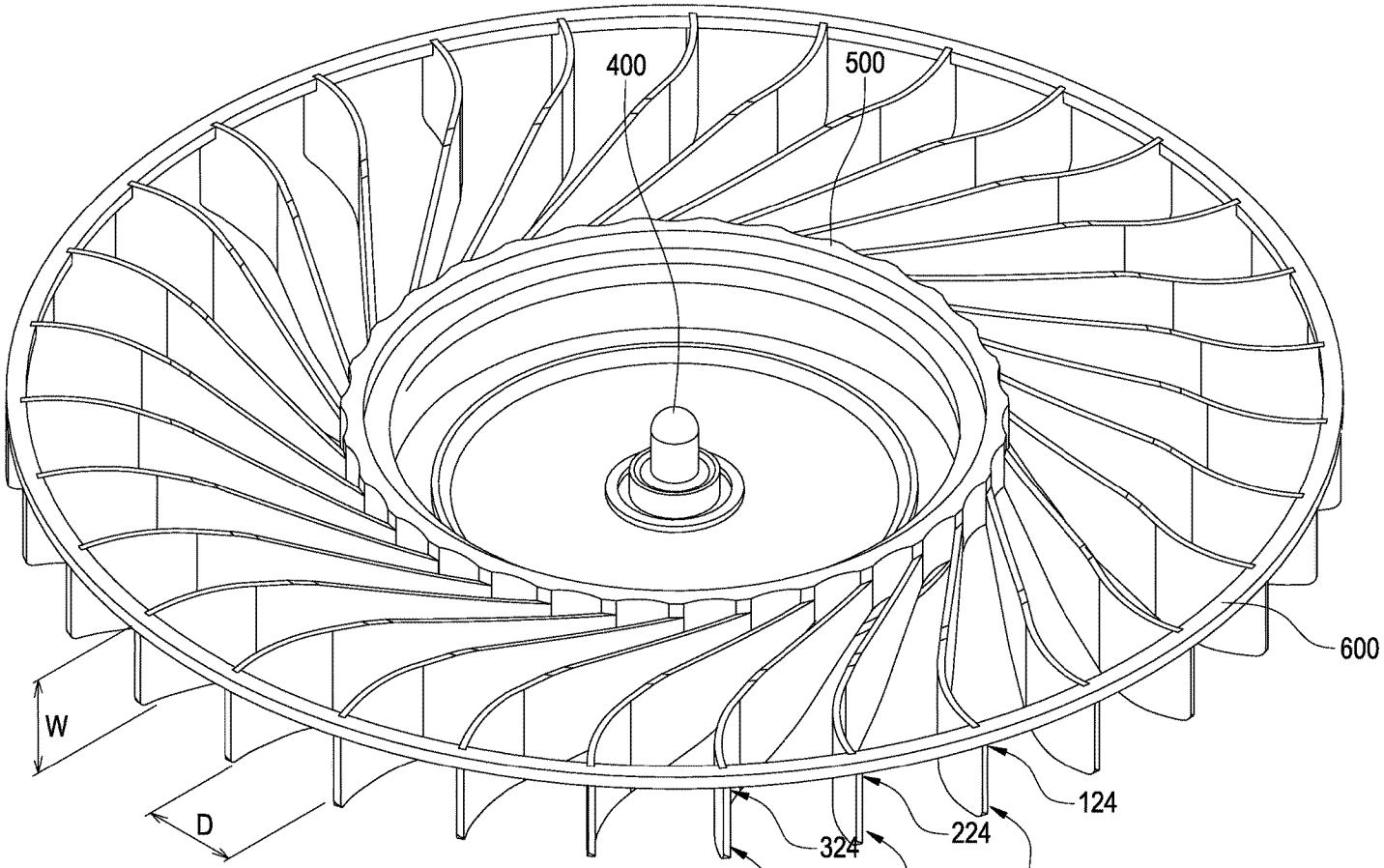
FIG. 13 is a possible variation view of the outer ring bracket according to the third embodiment of the present invention.

The third embodiment differs from the first embodiment mainly relies in that one end of each metal blade 120/220/320 is respectively connected to an outer edge of the corresponding metal ring bracket 110/210/310, and another end of each metal blade 120/220/320 is respectively formed of a clamping engagement structure 124/224/324. The outer ring bracket 600 is manufactured by an enclosure injection molding method to circumference the stack of metal ring brackets 110/210/310; in addition, the clamping engagement structures 124/224/324 are embedded at the outer ring bracket 600 in order to achieve the effect of positioning the metal blade 120/220/320. Furthermore, by using the outer ring bracket 600 to connect with the plurality of metal blades 120/220/320, the effect of strengthening the fan impeller structure can be achieved. The position of the outer ring bracket 600 in the present invention is not limited to any particular position; for example, FIG. 13 shows another embodiment in which the clamping engagement structure and the outer ring bracket are configured at other possible locations.

The fan impeller of the present invention utilizes the method of stacking a plurality of fan blade assembly members together for the assembly of the metal blades while the metal blades are respectively formed on each fan blade assembly member. As a result, the present invention not only allows connected metal blades of a relatively greater width can be formed by stamping method but also allows the metal blades to be densely arranged on the fan impeller in addition to that such configuration is facilitated for assembly.

In view of the above, it shall be noted that the above description provides preferred embodiments of the present invention only, which shall not be treated as limitation of the scope of the present invention. Any equivalent techniques and technical modifications based on the content of the specification and drawings of the present invention shall be deemed to be within the scope of the present invention.

What is claimed is:

1. A fan impeller, comprising:

a plurality of fan blade assembly members, each one of the fan blade assembly members respectively comprising a metal ring bracket and a plurality of metal blades, one end of each one of the metal blades respectively being connected to the corresponding metal ring bracket and the plurality of metal blades of each one of the fan blade assembly members being arranged radially to circumference the corresponding metal ring bracket;

wherein the plurality of metal ring brackets are configured to stack with each other and the plurality of metal blades are arranged in a radial centric row, a width of at least one portion of each one of the metal blades is not smaller at an outer circumference of the fan blade assembly than a distance between any two adjacent metal blades at an outer circumference of the fan blade assembly along a circumferential direction of the fan impeller.

2. The fan impeller according to claim 1, wherein another end of each one of the metal blades is respectively formed of a connecting structure.

3. The fan impeller according to claim 2, wherein the connecting structure is connected to the adjacent metal blade.

4. The fan impeller according to claim 3, wherein the connecting structure is locked onto the adjacent metal blade.

5. The fan impeller according to claim 1, further comprising an outer ring bracket, the outer ring bracket circumferencing each one of the metal ring brackets, and the outer ring bracket is respectively connected to each one of the metal blades.

6. The fan impeller according to claim 5, wherein another end of each one of the metal blades is respectively formed of a clamping engagement structure, and the clamping engagement structure is embedded at the outer ring bracket.

7. The fan impeller according to claim 1, further comprising a fan hub, and the plurality of metal ring brackets being embedded at the fan hub.

8. The fan impeller according to claim 7, further comprising a rotational axle assembly member, the plurality of metal ring brackets circumferencing the rotational axle assembly member, and the rotational axle assembly member being embedded at the fan hub.

9. The fan impeller according to claim 1, wherein each one of the metal blades is connected to an outer edge of the corresponding metal ring bracket.

10. The fan impeller according to claim 1, wherein a connecting area between each one of the metal blades and the corresponding metal ring bracket is bent.

11. The fan impeller according to claim 1, wherein an inner edge of one of the metal ring bracket includes a ring wall extended therefrom, and the rest of the metal ring brackets are mounted onto the ring wall.

12. A fan impeller, comprising:

a plurality of fan blade assembly members, each one of the fan blade assembly members respectively comprising a metal ring bracket and a plurality of metal blades, one end of each one of the metal blades respectively being connected to the corresponding metal ring bracket and the plurality of metal blades of each one of the fan blade assembly members being arranged radially to circumference the corresponding metal ring bracket;

wherein the plurality of metal ring brackets are configured to stack with each other and the plurality of metal blades are arranged in a radial centric row, a width of at least one portion of each one of the metal blades is not smaller than a distance between any two adjacent metal blades along a circumferential direction of the fan impeller, and wherein an inner edge of one metal ring bracket of the plurality of metal ring brackets includes a ring wall extended therefrom, and the rest of the metal ring brackets use the ring wall to nest on the one metal ring bracket.

13. A fan impeller, comprising:

a plurality of fan blade assembly members, each one of the fan blade assembly members respectively comprising a metal ring bracket and a plurality of metal blades, one end of each one of the metal blades respectively being connected to the corresponding metal ring bracket and the plurality of metal blades of each one of the fan blade assembly members being arranged radially to circumference the corresponding metal ring bracket;

wherein the plurality of metal ring brackets are configured to stack with each other and the plurality of metal blades are arranged in a radial centric row, a width of at least one portion of each one of the metal blades is not smaller than a distance between any two adjacent metal blades along a circumferential direction of the fan impeller, and wherein another end of each one of the metal blades is respectively formed of a connecting structure, the connecting structure comprising a tab which extends in the circumferential direction and which is connectable to the adjacent metal blade in the circumferential direction.

14. A fan impeller, comprising:

a plurality of fan blade assembly members, each one of the fan blade assembly members respectively comprising a metal ring bracket and a plurality of metal blades, one end of each one of the metal blades respectively being connected to the corresponding metal ring bracket and the plurality of metal blades of each one of the fan blade assembly members being arranged radially to circumference the corresponding metal ring bracket; and an outer ring bracket, the outer ring bracket attached to the outer ends of the metal blades;

wherein the plurality of metal ring brackets are configured to stack with each other and the plurality of metal blades are arranged in a radial centric row, a width of at least one portion of each one of the metal blades is not smaller than a distance between any two adjacent metal blades along a circumferential direction of the fan impeller, and wherein another end of each one of the metal blades is respectively formed of a clamping engagement structure, and the clamping engagement structure is embedded at the outer ring bracket.

* * * * *